US005107199A

United States Patent [19]

Vo et al.

[11] Patent Number: 5,107,199

[45] Date of Patent: Apr. 21, 1992

[54] TEMPERATURE COMPENSATED RESISTIVE CIRCUIT

[75] Inventors: Tuan A. Vo, Hawthorne; Mohammed M. Mojaradi, Los Angeles, both of Calif.

[73] Assignee: Xerox Corporation, Stamford, Conn.

[21] Appl. No.: 632,782

[22] Filed: Dec. 24, 1990

[51] Int. Cl.[5] ..... G05F 3/26

[52] U.S. Cl. ..... 323/316; 323/907; 323/315; 323/267

[58] Field of Search ..... 323/907, 312, 313, 315, 323/316, 267

[56] References Cited

U.S. PATENT DOCUMENTS

| | | | |
|---|---|---|---|
| 4,251,743 | 2/1981 | Hareyama | 307/296.7 |
| 4,280,091 | 7/1981 | Hiltner | 323/315 |
| 4,602,207 | 7/1986 | Kim et al. | 323/313 |
| 4,674,369 | 6/1987 | Bowers et al. | 323/314 |
| 4,680,535 | 7/1987 | Talmor | 323/312 |
| 4,864,216 | 10/1989 | Kalata et al. | 323/315 |

*Primary Examiner*—Steven L. Stephan

*Assistant Examiner*—Ben Davidson

*Attorney, Agent, or Firm*—Daniel J. O'Neill

[57] ABSTRACT

The present invention is directed to circuitry which uses a reference voltage and a reference current to produce a resistance which stays essentially constant even when the temperature of the device varies. The circuitry of a preferred embodiment consists of a resistor and a n-channel FET. The source of the FET is connected to ground, and the drain is connected to one terminal of the resistor. The other terminal of the resistor is connected to a reference current source and to the noninverting terminal of an operation amplifier. The inverting terminal of the operational amplifier is connected to a reference voltage. The output of the operational amplifier is connected to the gate of the FET. The value of the resistor is chosen such that the voltage drop across the FET (I.e., $V_{ds}$) is small so that the FET operates in the linear region. A resistive element is composed of the resistor and the on-resistance of the FET. the resistance of the resistive element is held constant by means of a feedback loop from the operational amplifier.

4 Claims, 2 Drawing Sheets

TEMPERATURE COMPENSATED RESISTIVE CIRCUIT

This invention relates to resistive circuits, and in particular, to resistive circuitry that is compensated for changes in temperature.

Integrated circuit design often requires fabrication of resistors that are insensitive to changes in temperature. However, the most common types of integrated circuit resistors (e.g., diffusion resistors and thin film resistors) have resistance that varies with temperature.

In the past, temperature insensitive resistors have been constructed by the series pairing of a passive resistor. which has a positive temperature coefficient, with the junction of a semiconductor device that has a negative temperature coefficient on an offsetting magnitude. One such example is U.S. Pat. No. 4,602,207, which shows current source circuitry consisting of a first n-channel FET and voltage generator circuitry coupled to the gate of the first FET so that it controls the current through the first FET. The voltage generator circuitry consists of a second FET, a two input differential operational amplifier, a resistor, and an n-p-n transistor to offset the positive temperature coefficient of the resistor. The amplifier and the second FET form a negative feedback path to ensure against current changes in the first and second FETs.

Similarly, a temperature insensitive voltage reference is described by U.S. Pat. No. 4,677,369, which shows a pair of parasitic bipolar transistors coupled with appropriate resistors to produce a voltage with a temperature coefficient that is equal in value but of opposite polarity to a zener diode voltage-temperature coefficient. This voltage is combined with the voltage of the zener diode to give the desired output reference voltage.

The present invention is directed to circuitry which uses a reference voltage and a reference current to produce a resistance which stays essentially constant even when the temperature of the device varies. The circuitry of a preferred embodiment consists of a resistor and a n-channel FET. The source of the FET is connected to ground, and the drain is connected to one terminal of the resistor. The other terminal of the resistor is connected to a reference current source and to the noninverting terminal of an operational amplifier. The inverting terminal of the operational amplifier is connected to a reference voltage. The output of the operational amplifier is connected to the gate of the FET. The value of the resistor is chosen such that the voltage drop across the FET (i.e., $V_{ds}$) is small so that the FET operates in the linear region. A resistive element is composed of the resistor and the on-resistance of the first MOSFET. The resistance of the resistive element is held constant by means of a feedback loop from the operational amplifier.

Figure 1:
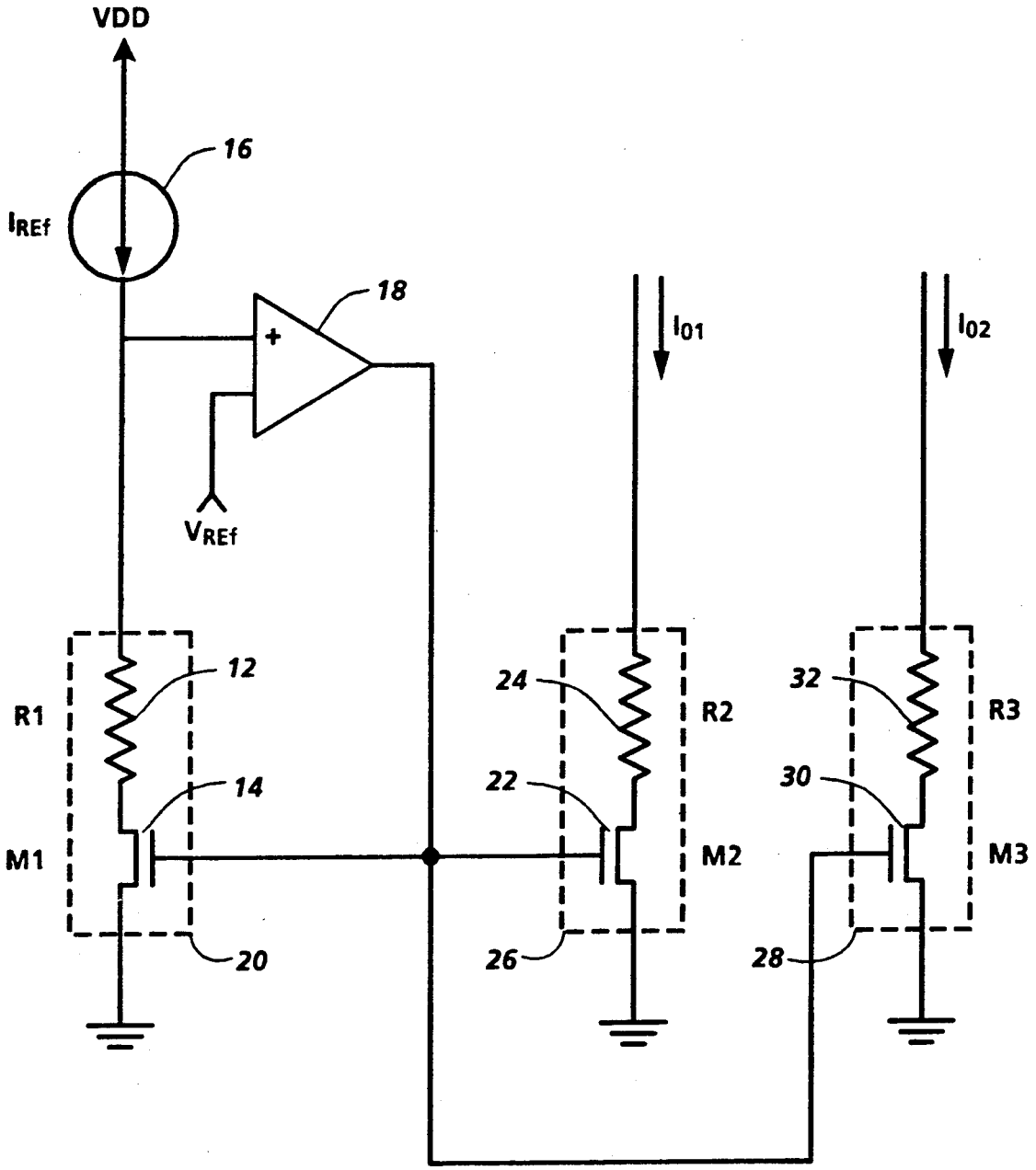
Figure 2:
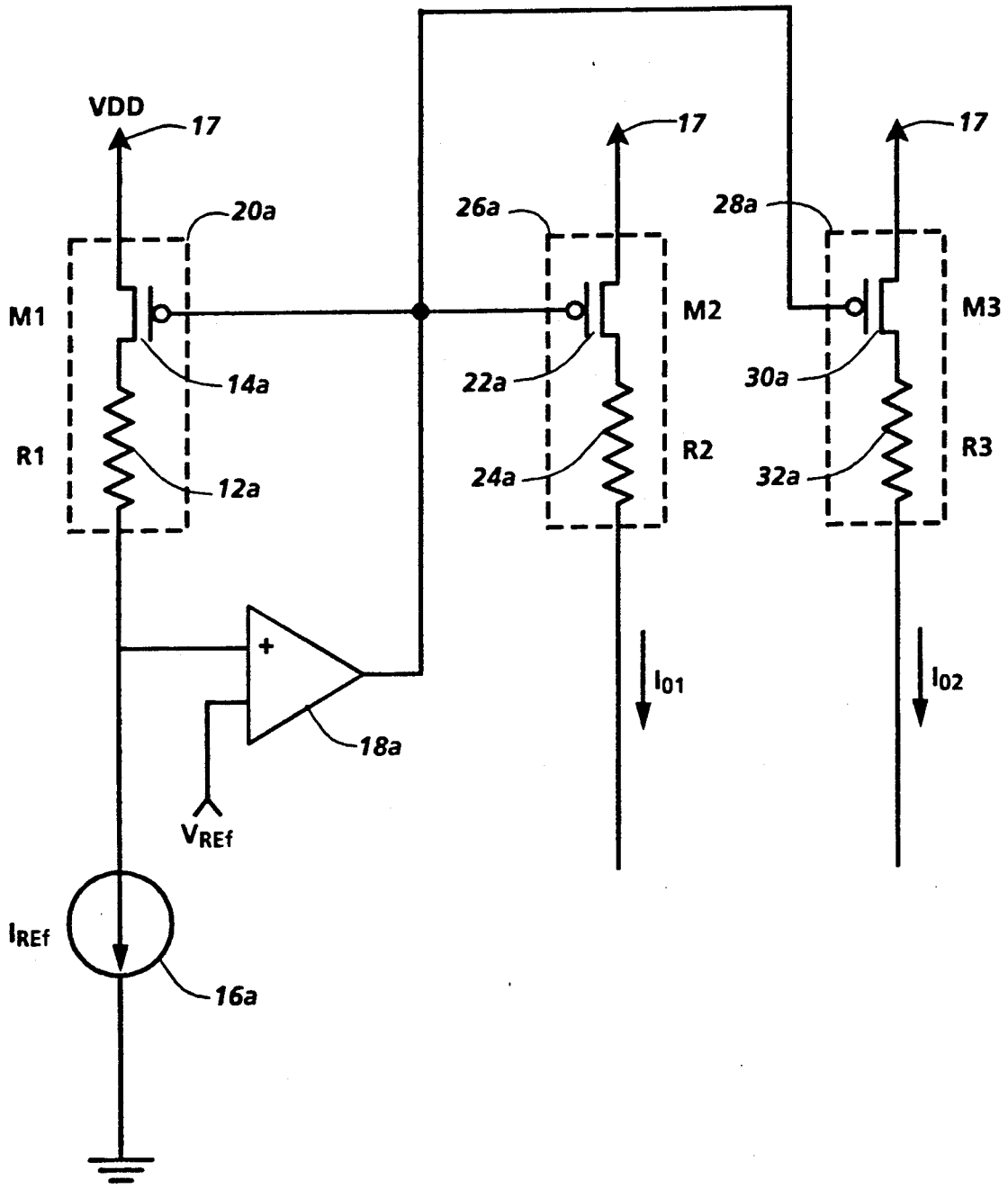

Other aspects of the invention will become apparent from the following description with reference to the drawings, wherein:

FIG. 1 is a schematic diagram of a first embodiment of the present invention; and FIG. 2 is a schematic diagram of a second embodiment of the present invention.

Referring now to FIG. 1, there is shown a schematic diagram of a first embodiment of the present invention. The diagram shows the present invention employed in a circuit suitable for providing an integrated circuit with multiple temperature insensitive resistive elements. A semiconductor resistor 12 is connected in series with an n-channel FET 14, which has its source connected to ground and its drain connected to one terminal of resistor 12. Preferably, FET 14 is a MOSFET, although another type of FET (e.g., JFET or MESFET) could be used. The other terminal of resistor 12 is connected to a current source 16, which provides a reference current $I_{REF}$, that is temperature insensitive, and to the noninverting terminal of an operational amplifier 18. Current source 16 can either be provided by circuitry on, or external to, the integrated circuit chip housing the invention. The inverting terminal of amplifier 18 is connected to a voltage reference $V_{REF}$. $V_{REF}$ is a temperature insensitive voltage, and can either be provided by circuitry on, or external to, the integrated circuit chip housing the invention. This voltage also appears at the noninverting terminal of amplifier 18. The output of the amplifier 18 is connected to the gate of MOSFET 14. A resistive element 20 is composed of the resistor 12 and the on-resistance of FET 14. The value of resistor 12 is chosen so that the voltage drop across FET 14 (i.e., $V_{ds}$) is small so that FET 14 operates in the linear region.

The on-resistance of a MOSFET operating in the linear region is given by the following equation:

$$R_{on}=1/[k_p(W/L)(V_{gs}-V_T)],$$

where, for the MOSFET, $k_p$ is the gain factor, W is the channel width, L is the channel length, $V_{gs}$ is the gate to source voltage, and $V_T$ is the threshold voltage. As the temperature of the integrated circuit chip housing the circuit changes, the temperature and hence the resistance of resistor 12 will change, thereby changing the voltage drop across resistive element 20. The change in the voltage drop across resistive element 20 will cause an offset voltage between the two inputs of amplifier 18. In response, amplifier 18 will alter the $V_{gs}$ of FET 14. From the above equation, altering $V_{gs}$ of FET 14 alters its on-resistance, thereby returning the overall resistance of resistive element 20 to its original value. It can be seen that the resistance of the resistive element 20 is held constant by means of a feedback loop from the operational amplifier 18.

FIG. 2 shows a second preferred embodiment of the invention suitable for p-channel FETs. Components in FIG. 2 that are similar in function to components of the first preferred embodiments of FIG. 1 are labeled the same as in FIG. 1, except that the letter a follows the number (e.g., current source 16 in FIG. 1 becomes current sink **16*a* in FIG. 2). A semiconductor resistor 12*a* is connected in series with a p-channel FET 14*a*, which is its source connected to a voltage $V_{DD}$ 17 and its drain connected to one terminal of resistor 12*a*. Preferably, FET 14 is a MOSFET, although another type of FET (e.g., JFET or MESFET) could be used. The other terminal of resistor 12*a* is connected to a current sink 16*a*, which provides a reference current $I_{REF}$, and to the noninverting terminal of an operational amplifier 18*a*. The inverting terminal of amplifier 18*a* is connected to a voltage reference $V_{REF}$. The output of amplifier 18*a* is connected to the gate of FET 14*a*. A resistive element 20*a* is composed of the resistor and the on-resistance of the FET 14*a*. The value of resistor 12*a* is chosen so that the voltage drop across FET 14*a* (i.e. $V_{ds}$) is small so that FET 14*a*** operates in the linear region.

With few additional components, the present invention can be employed in a circuit to obtain more than one temperature insensitive resistive element. For example, FIG. 1 shows a second n-channel FET 22 with its source connected to ground, its gate connected to the gate of FET 14, and its drain connected to a resistor 24. Resistor 24 and the on-resistance of FET 22 form a second resistive element 26, through which a current $I_{01}$ flows. Similarly, a third resistive element 28 (through which a current $I_{02}$ flows) is formed by a third n-channel FET 30, with its gate connected to the gate of FET 14, connected in series with a third resistor 32. In this manner, the feedback loop from the operational amplifier 18 that holds the resistance of resistive element 20 constant also controls the $V_{gs}$ of FETs 22 and 30. Resistive elements 26 and 28 can be made to have different resistances than resistive element 20, yet still exhibit temperature insensitivity like resistive element 20, by appropriate scaling of the value of resistor 24 and resistor 32 with respect to that of resistor 12 and the channel width to length ratio of FET 22 and FET 30 with respect to that of FET 14. Similarly, in FIG. 2 the gate of FET 14*a* is connected to the gates of FETs 22*a* and 30*a*, and FETs 22*a* and 30*a* are connected in series with resistors 24*a* and 32*a*, respectively, to form resistive elements 26*a* and 28*a*.

While the invention has been described with reference to the structures disclosed, it is not confined to the specific details set forth, but is intended to cover such modifications or changes as may come within the scope of the following claims.

We claim:

1. A temperature compensated resistive circuit, comprising:

a reference voltage;

a reference current;

a resistor having first and second terminals, said first terminal being connected to said reference current;

a first n-channel FET having its source connected to ground and its drain connected to said second terminal of said resistor, said first n-channel FET operating in its linear region;

a second n-channel FET having its source connected to ground; and an operational amplifier having its inverting terminal connected to said reference voltage, its noninverting terminal connected to said first terminal of said resistor, and its output connected to the gates of said first and second n-channel FETs.

2. A temperature compensated resistive circuit supplied with a voltage $V_{DD}$, comprising:

a reference voltage;

a reference current;

a resistor having first and second terminals, said first terminal being connecting to said reference current;

a first p-channel FET having its source connected to $V_{DD}$ and its drain connected to said second terminal of said resistor, said first p-channel FET operating in its linear region;

a second p-channel FET having its source connected to $V_{dd}$; and an operational amplifier having its inverting terminal connected to said reference voltage, its noninverting terminal connected to said first terminal of said resistor, and its output connected to the gates of said first and second p-channel FETs.

3. The resistive circuit of claim 1, wherein the resistive of said resistor is chosen such that the voltage drop between the source and drain of said first n-channel FET causes said first n-channel FET to operate in its linear region.

4. The resistive circuit of claim 2, wherein the resistance of said resistor is chosen such that the voltage drop between the source and drain of said first p-channel FET causes said first p-channel FET to operate in its linear region.

* * * * *